US011064786B2

(12) United States Patent
Böhm et al.

(10) Patent No.: US 11,064,786 B2
(45) Date of Patent: Jul. 20, 2021

(54) DEVICE FOR APPLYING A LIQUID MEDIUM

(71) Applicant: Thomas-Maximilian Böhm, Aachen (DE)

(72) Inventors: Thomas-Maximilian Böhm, Aachen (DE); Leon Cornelius Pollmeier, Aachen (DE); Hanna Kruczek, Aachen (DE)

(73) Assignee: Thomas-Maximilian Böhm

( * ) Notice: Subject to any disclaimer, the term of this patent is extended or adjusted under 35 U.S.C. 154(b) by 59 days.

(21) Appl. No.: 16/325,782

(22) PCT Filed: Aug. 15, 2017

(86) PCT No.: PCT/EP2017/070677
§ 371 (c)(1),
(2) Date: Feb. 15, 2019

(87) PCT Pub. No.: WO2018/033538
PCT Pub. Date: Feb. 22, 2018

(65) Prior Publication Data

US 2019/0200725 A1 Jul. 4, 2019

(30) Foreign Application Priority Data

Aug. 16, 2016 (DE) ..... 10 2016 215 288.2

(51) Int. Cl.
*A45D 34/04* (2006.01)
*A45D 29/00* (2006.01)

(52) U.S. Cl.
CPC ..... *A45D 34/042* (2013.01); *A45D 29/00* (2013.01); *A45D 34/04* (2013.01); *A45D 34/041* (2013.01);
(Continued)

(58) Field of Classification Search
CPC ..... A46B 5/0025; A46B 5/0029; A46B 7/02; A46B 7/023; A46B 7/026; A46B 9/10;
(Continued)

(56) References Cited

U.S. PATENT DOCUMENTS 1,616,484 A * 2/1927 Beynon ..... A46B 9/045 15/167.2
5,141,290 A * 8/1992 Mairon ..... A46B 11/00 15/167.1
(Continued)

FOREIGN PATENT DOCUMENTS

DE 20 2005 012 447 U1 10/2005
EP 0023407 A1 2/1981
(Continued)

OTHER PUBLICATIONS

International Search Report and Written Opinion for corresponding International Application No. PCT/EP2017/070677, dated Nov. 23, 2017.

*Primary Examiner* — David P Angwin
*Assistant Examiner* — Bradley S Oliver
(74) *Attorney, Agent, or Firm* — Tarolli, Sundheim, Covell & Tummino LLP

(57) ABSTRACT

A device for applying a liquid or pulverulent medium is provided. The device includes an application element that has a flexible width and that is attached between two support elements and includes at least one lateral delimiting element for the purposes of a controlled and fast application of this liquid or pulverulent medium. A kit that includes the device and a media container is provided.

12 Claims, 10 Drawing Sheets

(52) U.S. Cl.
CPC ..... *A45D 34/046* (2013.01); *A45D 2029/008* (2013.01); *A46B 2200/1046* (2013.01)

(58) Field of Classification Search
CPC .. A45D 34/041; A45D 34/042; A45D 34/043; A45D 34/046; A45D 40/261; A45D 40/262; A45D 40/264; B05C 17/0212
USPC ..... 401/122, 193, 208; 15/230.11
See application file for complete search history.

(56) References Cited

U.S. PATENT DOCUMENTS

| | | | | |
|---|---|---|---|---|
| 6,505,374 | B1 * | 1/2003 | Weihrauch | B05C 17/0227 15/230.11 |
| 7,033,101 | B2 * | 4/2006 | Han | A46B 11/0006 401/122 |
| 8,021,066 | B2 * | 9/2011 | Thiebaut | A45D 34/045 401/121 |
| 8,382,727 | B1 | 2/2013 | Martin | |
| 9,333,528 | B2 * | 5/2016 | DeCarr | B05C 17/0225 |
| 10,010,905 | B1 * | 7/2018 | Kelly | B05C 17/0205 |
| 2013/0067670 | A1 * | 3/2013 | Liangco | A46B 9/06 15/167.2 |

FOREIGN PATENT DOCUMENTS

| | | | |
|---|---|---|---|
| EP | 0503706 | A1 | 9/1992 |
| EP | 1836921 | A1 | 9/2007 |
| FR | 2569960 | A1 | 3/1986 |
| FR | 2825903 | A1 | 12/2002 |
| NL | 1037144 | C | 1/2011 |

* cited by examiner

A

B

DEVICE FOR APPLYING A LIQUID MEDIUM

RELATED APPLICATIONS

The present invention is a U.S. National Stage under 35 USC 371 patent application, claiming priority to Serial No. PCT/EP2017/070677, filed on 15 Aug. 2017; which claims priority of DE 10 2016 215 288.2, filed on 16 Aug. 2016, the entirety of both of which are incorporated herein by reference.

FIELD OF THE INVENTION

The invention relates to a device for applying a liquid or pulverulent medium, comprising an application element having a flexible width and having at least one lateral delimiting element in order to exactly and easily apply this liquid or pulverulent medium. The invention also relates to a kit comprising this device as well as a container that holds the liquid medium and that has a scraping implement for scraping the liquid or pulverulent medium off the delimiting element and/or off the application element. The invention also relates to a method for applying a liquid or pulverulent medium using the device according to the invention.

BACKGROUND OF THE INVENTION

The state of the art discloses numerous devices for applying a liquid medium, especially from the realm of cosmetic products. Nowadays, the liquid medium is applied with application implements such as brushes or rollers, but this can also be done with a spraying device. The devices know from the state of the art are normally used in conjunction with a container that holds the medium that is to be applied.

In particular, it is a challenge to paint fingernails or toenails neatly. Nails have curved surfaces whose contours vary. An optimal application of nail polish should yield a smooth surface without ridges, bubbles, pores, inclusions or runs. Moreover, the coating should be uniformly thick and should cover the entire surface area. The greatest difficulty, however, is to paint the entire surface area of the nail without applying the nail polish onto the adjacent nail fold or cuticles.

This is made more difficult by the rapid hardening of the nail polish, which leaves the user very little time to process the polish. Since a first application hardens partially on the surface very quickly, painting over it often leads to irregularities in the polish surface.

Consequently, in view of the circumstances described above, it is very difficult to create a neatly contoured and smooth polish surface with conventional nail polish brushes. Therefore, it is very likely that inexperienced users will make mistakes when painting the nails, that is to say, they will also paint the adjacent nail bed or even the skin of the fingers or toes, or only part of the surface of the nails, or else they will even end up with a messy surface. This explains why a large percentage of women (55% of them according to a poll conducted in Dusseldorf in 2016) rarely or never paint their nails, even though they have a positive opinion of polished nails.

Before this backdrop, the first automated devices for an improved application of nail polish have now been developed. In order to achieve a neatly contoured polish application, templates or adhesive tapes are used for delimiting purposes. This approach is awkward and error-prone, often requiring an after-treatment (for example, cleaning the templates or removing polish residues that "creep" under the template or the adhesive tape).

As an alternative, the nail bed can be coated with silicone compounds or oils that repel the nail polish. This involves an additional processing step, whereby if these compounds are not applied neatly onto the nail bed, they immediately lead to a messy application of the nail polish. Moreover, the products employed often contain substances that are harmful to the organism or to the environment.

German Preliminary Published Application DE 3708984 A1 relates to a brush, especially for nail polish, whose holder has at least two stems (2, 3) with two bristle bundles (4, 5) (see FIG. 1). In this manner, a wider polish application is possible and several colors of nail polish can be applied next to each other in one step. However, this brush also has the drawback that the nail polish can easily get onto the adjacent nail fold.

European patent application EP 1 836 921 A1 relates to a nail polishing device with a roller. The roller can have different surfaces. It is intended to achieve a controlled, that is to say, more uniform polish application. However, this presupposes that the preceding scraping of the roller is also carried out in an equally controlled manner. In particular, a roller has the drawback that the polish application "bleeds" to the sides and thus no clear boundary is created, and moreover, a cylindrical roller does not produce a uniform application on curved surfaces.

German patent application DE 199 60 511 A1 relates to a device and to a method to automatically apply nail polish onto a fingernail. Here, first of all, a camera acquires an image of the fingernail and, after the image has been analyzed, converts it into a processing path, whereby an applicator then applies the nail polish while following the processing path. This method is complicated and expensive, thus making it unsuitable for private use.

Therefore, there is a need for an improved application device for liquid media and especially for the application of nail polish.

SUMMARY OF THE INVENTION

The objective of the present invention is to provide a device for applying a pulverulent or liquid medium that constitutes an improvement in terms of the above-mentioned disadvantages in that it diminishes or even completely eliminates the drawbacks.

According to the invention, the objective is achieved by a device according to claim 1. Specific embodiments of the invention are the subject matter of the additional dependent or independent claims.

In a first aspect, the invention puts forward a device for applying a pulverulent or liquid medium, comprising the following:

(a) an application element that serves to apply a liquid or pulverulent medium, that is situated between two support elements, and whose width can be changed flexibly; and (b) at least one delimiting element that is positioned laterally on the (c) application element and that is configured in such a way that it adapts to the flexible width of the application element and that laterally delimits the media application.

The device according to the invention has numerous advantages over the containers known from the state of the art.

First of all, the device according to the invention has an application element whose width can be changed flexibly. In a manner controlled either by the user or by the contour of the surface, this makes it possible to vary the width of the media application and thus to adapt it to the contour of the surface. Thus, the device is ideally adapted to the spatula-like contour of nails and the application can be carried out without stages or jerkiness as it adapts to the shape of the fingernails or toenails.

This width adaptation also makes it possible to neatly paint the nails with one brushstroke which, on the one hand, saves time and, on the other hand, minimizes the risk of painting errors.

The fast media application also has the advantage that, even media that dry or harden rapidly (e.g. polishes containing highly volatile solvents) can be applied. Liquid media with even shorter processing times, which could not be used up until now for application reasons, are now also available for application purposes for the first time.

The width of the application implement is changed in that the application implement is uniformly spread out, resulting in a still homogenous and thus optimal media application that also meets the requirement of a spill-free application with good properties in terms of the fine brushstrokes.

Almost any familiar technical configuration can be used as the application implement such as, for example, brushes, rollers, sponges or spraying devices, so that the device can be used in a wide array of applications.

The lateral width flexibility of the application element also makes it possible to advantageously use the device with the conventional media containers so that the device can easily be inserted into the container opening by narrowing the application implement. A narrow container opening is preferred, particularly in the case of nail polishes with highly volatile solvents.

Moreover, the device has a laterally positioned delimiting element. In a simple manner, it prevents the liquid or pulverulent medium from spilling over onto adjacent surfaces, thus yielding a media application with a precise lateral delimitation.

Therefore, the device can be used in a wide array of applications for all technical purposes where a liquid or pulverulent medium has to be applied with a precise delimitation line.

Since the device itself prescribes the delimitation, external aids such as templates or adhesive tapes can be dispensed with and the need for any after-treatment is eliminated. The result is thus a media application that is easy and quick to carry out.

The lateral delimiting elements also permit the use of elongated brushes that can pick up correspondingly larger amounts of the media. Such long brushes could not be used up until now in the state of the art since they spread out too much and yielded a messy media application. Therefore, the application implement can also pick up so much nail polish that frequent dipping of the applicator into a nail polish reservoir is avoided.

In a preferred embodiment of the invention, the delimiting element of the device comprises a guide element that detects the surface structures and contours so that consequently, it can variably control the delimitation on the basis of the detected structure or contour. Especially in the case of toenails or fingernails, the nail fold is a clearly detectable structure. The guide element can enter this fold and can regulate the width of the media application accordingly. Thus, even inexperienced users can paint the nails very precisely.

The device according to the invention is configured relatively simply and thus is not only cost-effective to produce but also user-friendly to employ.

To summarize, the device according to the invention is easy to use and allows a faster and better-quality application of the liquid or pulverulent medium.

THE INVENTION IN DETAIL

According to the invention, the application element of the device is situated between two support elements. In a preferred manner, owing to the variable spacing of the support elements relative to each other, the width of the application element located between them can be varied accordingly. As an alternative to this, the support elements can have a fixed spacing and the width of the application element situated between them can be varied independently thereof.

As set forth in the application, the width of the application element refers to the side of the application element that is perpendicular to the direction of the media application, thus defining the width of the media application.

Moreover, the width change relates at least to the part of the application element that is in contact with the surface that is to be processed and that thus ensures a direct transfer of the liquid or pulverulent medium onto the surface. In other words, according to the invention, it is not necessary for the width of the application element to be variable in its entirety. Thus, in the case of a bristle bundle, it is sufficient for only the width of the front area of the bristle bundle to be varied.

In one embodiment, the application element is attached directly to the support element. In an alternative embodiment, the application element can be joined to the support element indirectly via another element (e.g. via the axle of a roller).

In this context, the usual rod-shaped supports, which are known particularly from the realm of nail polish applicators, can be used as the support elements. Materials that can be used here are wood, metal or plastic. Preference is given to the use of flexible materials such as, for example, an elastomer material. Advantageously, this material is selected from the group comprising polyethylene such as high-density polyethylene (HDPE), polyurethane, polyester, polyether block amides, polyvinyls, terpolymers of ethylene, propylene and a diene (EPDM) and polymers of styrene-butadiene sequences (SEBS-SIS). In particular, the elastomer material has a hardness that is in the range from 35 to 90 Shore A and preferably in the range from 50 to 70 Shore A. In a likewise preferred embodiment, the elastomer material has a Shore hardness of D80.

The lateral positioning according to the invention of the delimiting element allows an adaptation to the width of the application element. This means that the delimiting element follows the changes in the width of the application element, that is to say, the spacing between the delimiting elements that are present on both sides is changed to the same extent as the width of the application element situated between them. In the simplest way, this requirement is fulfilled in that the at least one delimiting element is connected to the application element, whereby the spacing between the application element and the delimiting element is essentially unchangeable.

In a preferred embodiment, the delimiting element comprises a guide element that detects the contour and/or the structure of the surface and that is configured in such a way that it flexibly adapts the width of the media application to the contour of the surface during the media application. Thus, it is possible for the surface itself to determine the width of the media application and the user does not have to actively control the width.

For this purpose, in the simplest, embodiment, the delimiting element is designed to be tapered so that the pointed end enters into contours or structures of the surface and thus guides the material application appropriately. In an alternative embodiment, the guide element is a ball or a roller. The width $B_{FE}$ of the tapered guide element is selected in such a way that, for one thing, it can still correctly detect the contours or structure of the surface, but not so pointed that the surface would be damaged here.

In an alternative embodiment, the delimiting element supplies a marking for the current width of the media application. This can be done by means of a delimiting element that is tapered towards the end and that has a marked tip, as a result of which the user receives a clear indication of the width of the media application.

As an alternative, the marking can be displayed on the surface that is to be processed. For this purpose, (preferably miniaturized) light sources can be used that come from the device and project a light signal onto the surface, thereby showing the application boundaries to the user.

In an especially preferred embodiment of the invention, the delimiting element is attached directly to the side of the application element. In this manner, the liquid or pulverulent medium released by the application implement can be held back directly by the delimiting element and continues to be available for the media application.

In a preferred embodiment, the liquid medium is selected from the realms of cosmetic or medical products. Examples that can be mentioned here include lotions, gels, masks, mascara, eye shadow, products for denture care, coatings for the dental sector, hair conditioners, hair-coloring products, lip care products, nail polish, nail polish remover, nail care products, nail adhesives, adhesive gels, nail oil and medical products selected from among cavity coatings, medical care coatings and antimicrobial coatings.

In a particularly preferred embodiment, the liquid medium is selected from among nail polish, nail varnish, nail hardener, groove filler, nail polish remover, nail care products, nail adhesives, adhesive gel, nail oil, lip care products such as lipstick or lip gloss, make-up or coatings for the dental sector.

In an alternative embodiment, the medium to be applied is a pulverulent medium selected from the group comprising body powder, face powder, powder coatings and especially electrically hardening polishes as well as polishes that are hardened by means of UV light, heat or chemical processes.

In an alternative embodiment of the invention, the device is configured in such a way that it can be used to apply liquid or pulverulent media for non-biological applications such as, for instance, for coatings in the realm of furniture, textiles, leather goods, paper, construction materials, construction elements, metal, plastic, machinery, motor vehicles.

In another embodiment, the device according to the invention for applying the liquid or pulverulent medium is suitable for use on one of the following surfaces: a wall, the ceiling or floor surface of a building, a surface of a car body, a surface of a piece of furniture and the surface of food products.

In a preferred embodiment, this surface is the surface of the body of a human or animal.

In an especially preferred embodiment, this surface is the surface of toenails or fingernails, teeth, skin or hair.

Aside from the nails, the teeth are a particularly relevant area of application for the device according to the invention. The guide element can enter the interdental spaces, thereby allowing a neat and targeted application of medical or cosmetic media onto the teeth.

The application element can be designed in many different ways and the person skilled in the art can make use of all application modalities known from the state of the art. Thus, for instance, the application element can be configured as follows: fiber bundle, bristle bundle, brush, roller, flocked applicator, swab, sponge, nonwoven cloth, loop, spatula or spray head.

In the case of a flocked applicator, flocked fibers are applied onto a substrate using an adhesive.

Here, the application element can comprise one or more of the above-mentioned application modalities. Since there are two support elements, it is preferable for the application element to comprise exactly two such application modalities, that is to say, two bristle bundles or two brushes.

Advantageously, according to a first embodiment variant of the invention, the application element is made up in a conventional manner of a bundle of bristles arranged essentially in parallel. In particular, the bristle bundle has a length ($L_{AE}$) ranging from 8 mm to 40 mm and preferably from 11 mm to 20 mm. In this case, the applicator is a brush.

Relative to the width $B_{BE}$ of the delimiting element, the application element can be attached at the rear edge, in the middle or at the front edge of the delimiting element.

The application element is preferably attached in the middle of the delimiting element. Here, the depth of the application element (see FIG. 10: $T_{AE}$) is preferably narrower than the width of the delimiting element connected thereto (see FIG. 10: $B_{BE}$). In this manner, the delimiting element can easily laterally delimit the application of the polish.

In one embodiment, the bristle bundles are attached to the delimiting element or support element in such a way that a distance $\Delta_{AE\text{-}BE}$, preferably amounting to up to 1.5 mm, exists between the front edge of the bristle bundles and the inner edge of the guide element. In this manner, the application element can fan open laterally by this amount before it even touches the guide element.

According to this variant, the device preferably has a bundle of about 20 to 200 bristles, preferably about 50 to 150 bristles, that have a diameter ranging, for example, from 4 to 25 hundredths of a millimeter, preferably from 6 to 17 hundredths of a millimeter, and that are generally made of polyamide, for example, Nylon® 6,6-6,6-10,6-12 or Nylon® 11, polyester, polyacrylate, polyacetal or cellulose acetate. As an alternative, the bristles can be of a natural origin.

At least some of the bristles can be slightly wavy over their length. The bristles can have cross sections whose shape is selected from the group comprising circular, annular, polygonal, cruciform, rectangular, multilobular, U-shaped, C-shaped or V-shaped forms and/or they have at least one capillary groove. The free end of the bristles that form the applicator can be configured in the form of the head of a pin that was created especially by means of thermal treatment, for example, by means of singeing. The free end of the bristles can also be configured in a tapered form that was achieved, for instance, by polishing or carding.

Fundamentally, the bristle bundles can be held together in the form of a ring, for example, in a circular cylindrical flexible sleeve, and also as an oval, a square, a rectangle or in some other shape. Preference is given here to an elongated rectangle or an ellipsoid that, owing to the width adaptation, is changed into a rectangle with a changed lengthwise side or into an ellipsoid with a changed eccentricity.

Moreover, the bristle bundle can also have an arc-shaped or C-shaped cross section, whereby the concave bottom is meant to come into contact with the convex nail surface. In another embodiment, the bristle cross section can change its shape in that it is bought into contact with the surface in a controlled manner. Thus a bristle bundle (pair) with a convex configuration can "flip over" into a concave brush cross section by pressing it onto a likewise convex nail surface.

The surface defined by the ends of the bristles can be configured completely or at least partially, for example, in the form of a straight or oblique circular cone, a truncated cone, a pyramid, a truncated pyramid or a spherical segment, or else it can be configured to be quite tapered, as is known from fine hair paintbrushes known from art painting, or they can have the shape of a spherical tapered segment. Combinations of these shapes are also possible. Thus, the surface defined by the ends of the bristles can also be, for instance, truncated conical and can be rounded off in the upper section.

In a preferred embodiment, the surface defined by the ends of the bristles can have a convex curvature.

In one embodiment, if the end of the brush has a convex configuration, the guide element is at the same height on the front or else it is recessed by up to 2 mm (see distance $\Delta_{AE\text{-}FE:convex}$ in FIG. 10).

In an alternative embodiment, if the end of the brush has a concave configuration, the guide element is at the same height on the front, or else it projects by up to 2 mm (see distance $\Delta_{AE\text{-}FE:concave}$ in FIG. 10).

The material that forms the bristles can contain a substance that modifies its surface state and/or its sliding properties and/or its wettability with water and/or with a solvent, or else it can contain an antistatic agent.

Advantageously, the substance that improves the sliding properties of the fibers and that reduces its wettability with water and solvent is incorporated into the material of the bristles in a percentage that is between 0.2% by weight and 15% by weight, preferably between 0.3% by weight and 5% by weight.

This sliding agent is preferably selected from the group comprising polytetrafluorethylene, boronitride, molybdenum bisulfate, graphite, the silicones, fuller's earth and talcum.

Advantageously, the application element is attached to the support element, for example, by adhesion although this can also be done with any other known means that are normally used for the production of paintbrushes such as, for example, a clamping ring or a so-called anchoring method.

In another preferred embodiment, the application element consists of at least one bristle bundle that is connected to the device at one end and that has a spreading aid to uniformly distribute the individual bristles of the bristle bundle and to spread them out in a plane. For this purpose, the spreading aid is either joined to the bristles or it is clamped around the bristle bundle on both sides. In a preferred manner, the spreading aid is glued to the bristle bundle.

Advantageously, this spreading aid is made of an elastic material such as, for example, an elastomer, that can be elastically deformed under tensile or compressive strain but that then returns to its original non-deformed shape.

In a preferred embodiment, the elastomer is selected from the group comprising polyisoprene, polyisobutylene, isoprene/isobutylene copolymer and styrene-butadiene rubber, poly(organo)siloxane (silicone) as well as combinations thereof.

In an especially preferred embodiment, the spreading aid is made of a silicone compound.

In another especially preferred embodiment, the application element comprises at least one roller that can move flexibly crosswise to the axle of the roller. As a result, the roller can also generate a concave or convex application surface or even an application surface with a complex shape. Within the scope of the application of nail polish, the roller is deformed in an appropriately concave manner so as to optimally paint the nail surface.

Such a roller can thus be changed flexibly, not only widthwise, but also perpendicular thereto, and therefore it is particularly well-suited for applying liquid or pulverulent media onto surfaces that have complex structures.

In the case of a roller, various technical solutions can be used to achieve this width variability. For instance, the roller can be made entirely of an elastic material or it can have a harmonica-like structure. In a preferred embodiment, it is a spiral-shaped roller, whereby the spiral functions in the form of a spring element to provide the roller with a flexible width and moreover, the spiral has a surface structure that does not have a detrimental impact on the homogeneous application of the liquid or pulverulent medium.

In another embodiment, the roller used as the application element has a rolling aid, preferably in the form of a polygon and especially preferably in the form of a star that makes it easier to roll the roller on the surface.

In a preferred manner, this rolling aid is identical to the delimiting elements so that the roller according to the invention is delimited, for example, by two adjacent circular delimiting elements that have elevations (for example, in the form of the "star points"), thus facilitating the rolling process.

In an alternative embodiment, the rolling aid is at a distance from the delimiting elements. Thus, when a roller is used as the application element, the roller with its points can be affixed in the middle of the roller as a rolling aid. If this roller with points is sufficiently thin, then the uniform application of polish is not impaired, even with such a centered arrangement.

In an especially preferred embodiment, the tips of this rolling aid easily penetrate the surface intended for the application of the medium.

In an especially preferred embodiment, the application element consists of two bristle bundles that are each attached laterally to the inside of the two rod-shaped support elements, whereby the two rod-shaped support elements are coupled so as to pivot around a pivoting axle and they are preferably connected by at least one spring element in such a way that their pivoting motion can be pre-tensioned.

In another embodiment of the device according to the invention, the at least one delimiting element consists of a plate, a disk or it constitutes the distal end of the support element. In this case, the support element makes a transition to the delimiting element in the distal area, whereby the delimiting element is considered to be the area where, during the media application, the application element that is affixed in-between runs a risk of spreading this liquid or pulverulent medium to adjacent areas.

In an especially preferred embodiment, the at least one delimiting element is affixed as a preferably circular flat element that can rotate around its own axis.

The requisite pivotability of the two support elements and consequently also of the delimiting elements relative to each other is ensured by at least one pivoting axle and/or by a flexible material. Here, in a preferred manner, during this pivoting, a tension is built up in the support elements or delimiting elements that counteracts the pivoting.

In a preferred embodiment, metal, plastic, wood or fiberglass-reinforced plastic are used as the flexible material.

In a preferred embodiment of the device according to the invention, at least one of the surfaces of the guide element and/or of the delimiting element has a coating that exerts a repellant effect on the liquid or pulverulent medium being employed. In the case of a hydrophobic medium, this is appropriately an oleophobic, hydrophobic or superhydrophobic coating. In the case of a polar medium, it is advantageous to use a coating that causes a lotus effect, in other words, it forms a microstructure or a nanostructure that repels water.

In a second aspect, the invention puts forward a kit comprising the following:

a. a device according to the invention; and b. a container (media container) that holds the liquid or pulverulent medium that is to be applied, into which the device can be dipped.

The media container can have any desired shape, whereby preference it given to an upright container.

As an alternative, the container can also serve as a cap for the device which is configured as a pen. In one embodiment, the cap can simultaneously serve as a reservoir for the liquid or pulverulent medium.

In an alternative embodiment, the cap is only intended as a protection or closure option. In this case, the liquid or pulverulent medium can be taken from a separate container or else it is integrated into the pen so that it is fed to the application element from above.

In another embodiment, the media container holds a volume between 2 ml and 20 ml, preferably between 5 ml and 16 ml, and especially preferably between 8 ml and 13 ml.

In a preferred embodiment, the media container comprises a scraping implement for scraping the liquid or pulverulent medium off the guide element and/or off the delimiting element and/or off the support element.

In another preferred embodiment, the scraping implement is made of one of the following materials or means or else of a combination thereof: silicone, foam, a means that has an electrostatic affect.

In an especially preferred embodiment, the scraping implement for the delimiting element or guide element is configured as a gap that is at a distance from the media container and that is preferably configured so as to have a wavy shape. In this manner, the application element is selectively dipped into the liquid or pulverulent medium, where it picks up the medium while the delimiting element or guide element, separately therefrom, passes through the gap so that, in this process, any liquid or pulverulent medium that might still be present is removed from both sides of the application element.

In another embodiment, the media container also has a scraping implement for the application element in order to scrape off excess liquid or pulverulent medium. This is important, particularly with a roller-shaped application element since, after a roller has been dipped into liquid or pulverulent medium, there is especially a need for a uniform distribution of the medium on the roller surface while excess medium is removed. Here, the scraping implement for the application element can be configured in terms of its shape and material like the scraping implements described above. A scraping grid is preferred in the case of a roller.

In another embodiment, the media container has a trapezoidal tub to hold the liquid or pulverulent medium. When the device is dipped into this tub, the application element can pick up the liquid in a controlled manner. The trapezoidal design makes it possible to pull the device through the tub up to a controlled width of the application element, so that the width selected here matches the width of the surface that is to be processed. Thus, when a thumbnail is being painted, the quantity of the medium is predefined so that the optimal quantity of nail polish can be picked up.

In another aspect, the invention puts forward a device for applying a liquid or pulverulent medium, comprising the following:

(a) an application element that serves to apply a liquid medium that is situated outside of two support elements, and whose width can be changed flexibly; and (b) at least one delimiting element that is positioned laterally on the (c) application element and that is configured in such a way that it adapts to the flexible width of the application element and that laterally delimits the media application towards the inside.

In this embodiment, the teaching according to the invention pertaining to the polish application is inverted. The application elements are now located on the outside, in other words, to the right and left towards the outside relative to the two support elements. Since their width can be flexibly adapted, two separate application tracks can be created. Here, the media application is then laterally delimited on the inside.

In another aspect, the invention relates to a method for applying a liquid medium, comprising the following steps:

(a) the application implement of the device according to the invention is dipped into the liquid or pulverulent medium, a process in which the liquid or pulverulent medium is picked up;

(b) the excess liquid or pulverulent medium is scraped off the application element and/or off the delimiting element and/or off the guide element;

(c) the liquid or pulverulent medium is applied onto the surface by bringing the application element into contact with the surface.

These and other aspects of the invention are described in detail in the figures and in the examples of embodiments. The figures show the following:

EMBODIMENTS

Figure 1:
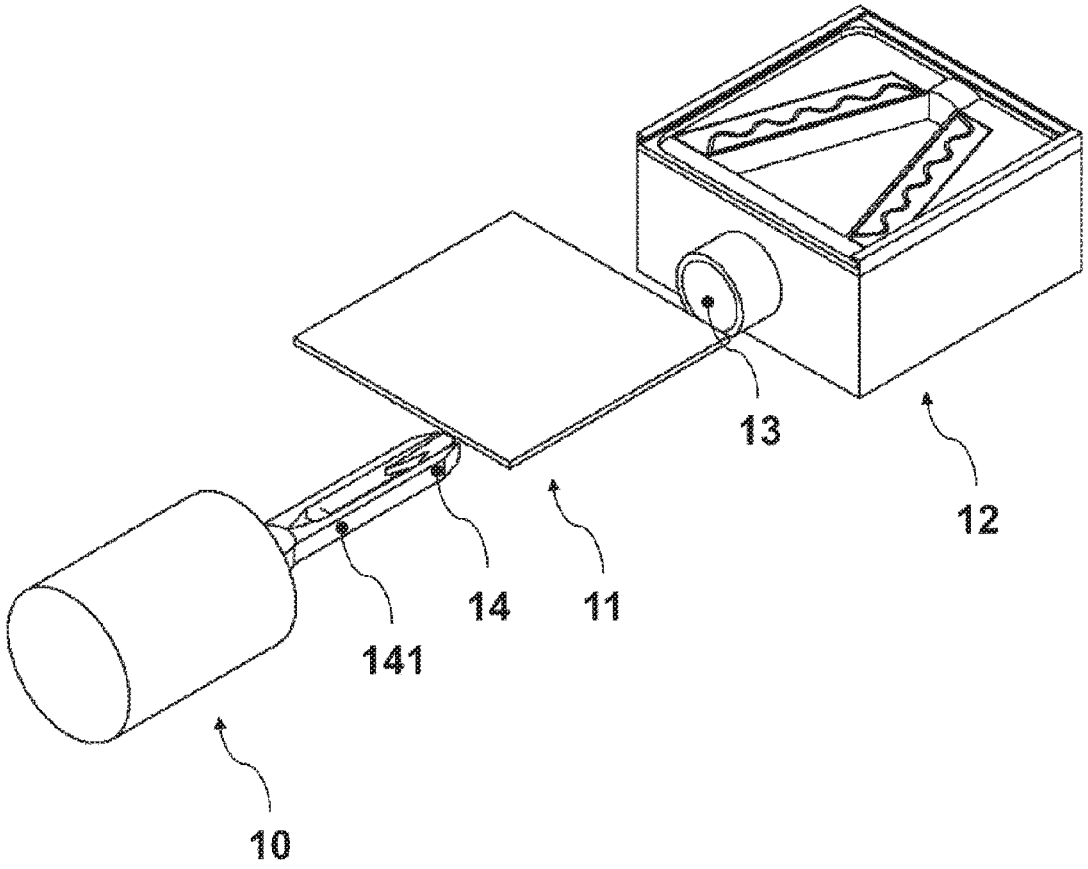
FIG. 1 shows an embodiment of the device according to the invention together with the media container according to the invention, which can be closed with a cover.

The embodiment in FIG. 1 shows the kit according to the invention comprising the device 10 for applying the liquid medium as well as a media container 12 with a cover 11 to close the media container. The device 10 is inserted through the opening 13 into the storage chamber in order to be stored. For purposes of applying the product, the cover 11 of the media container 12 is removed and the device 10 is inserted into the media container 12 from above, where it is dipped into the liquid medium that is present in the middle trapezoidal chamber. In this context, the delimiting elements 14 or the guide elements are moved along the V-shaped lateral guides, causing excess liquid medium to be scraped off both sides of the delimiting elements 14.

Figure 2:
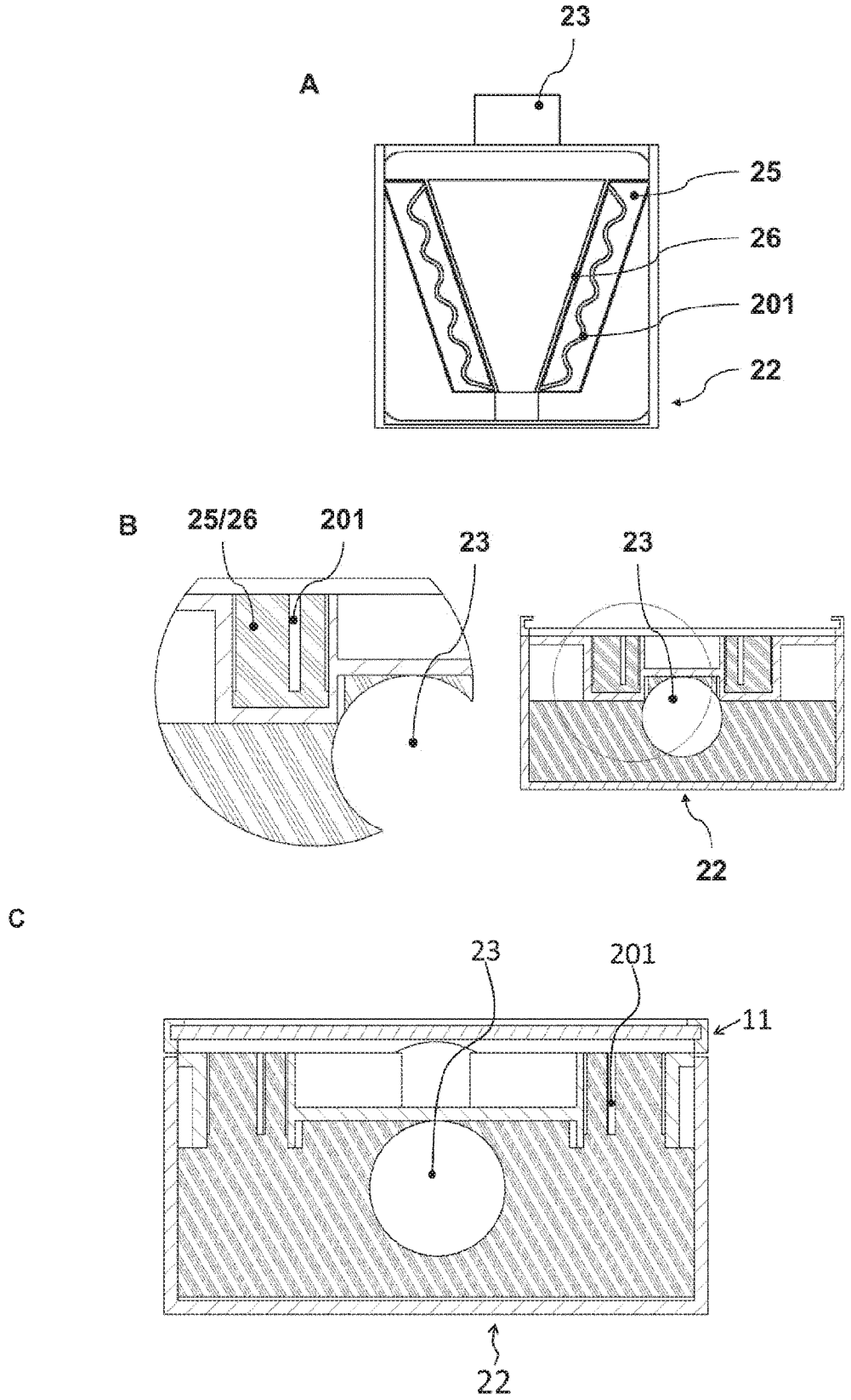
FIG. 2 shows a side cross sectional view (A) as well as a top view, likewise in a cross section, with an enlarged view of the area of the lateral guide (B) of the media container, as well as in (C), likewise in a cross section, with a different configuration of the suction element (shown by a broken line) inside the container.

FIG. 2 shows the media container 22 with the opening 23 for storing the device. As the cross section in B shows, the round storage chamber 23 is surrounded by absorptive material—shown by cross hatching—that ensures that excess material is removed and/or that, when soaked with solvent, prevents the liquid medium from drying up. The device is inserted in such a way that the application element dips into the liquid medium between the V-shaped lateral guide 26, where it can pick up the medium. The guide element or the delimiting element is inserted into the gap 201 so that it does not come into contact with the liquid medium. Remaining liquid medium is scraped off while being pulled through the gap 201 that functions as a scraping implement 25. The enlarged depiction illustrates the position of the scraping implement—a foam in this embodiment—in the media container 22. In the embodiment shown in (C), the lower storage area and the upper application area form a joint foam element that consequently, in contrast to the device of (A), does not have a separation.

Figure 3:
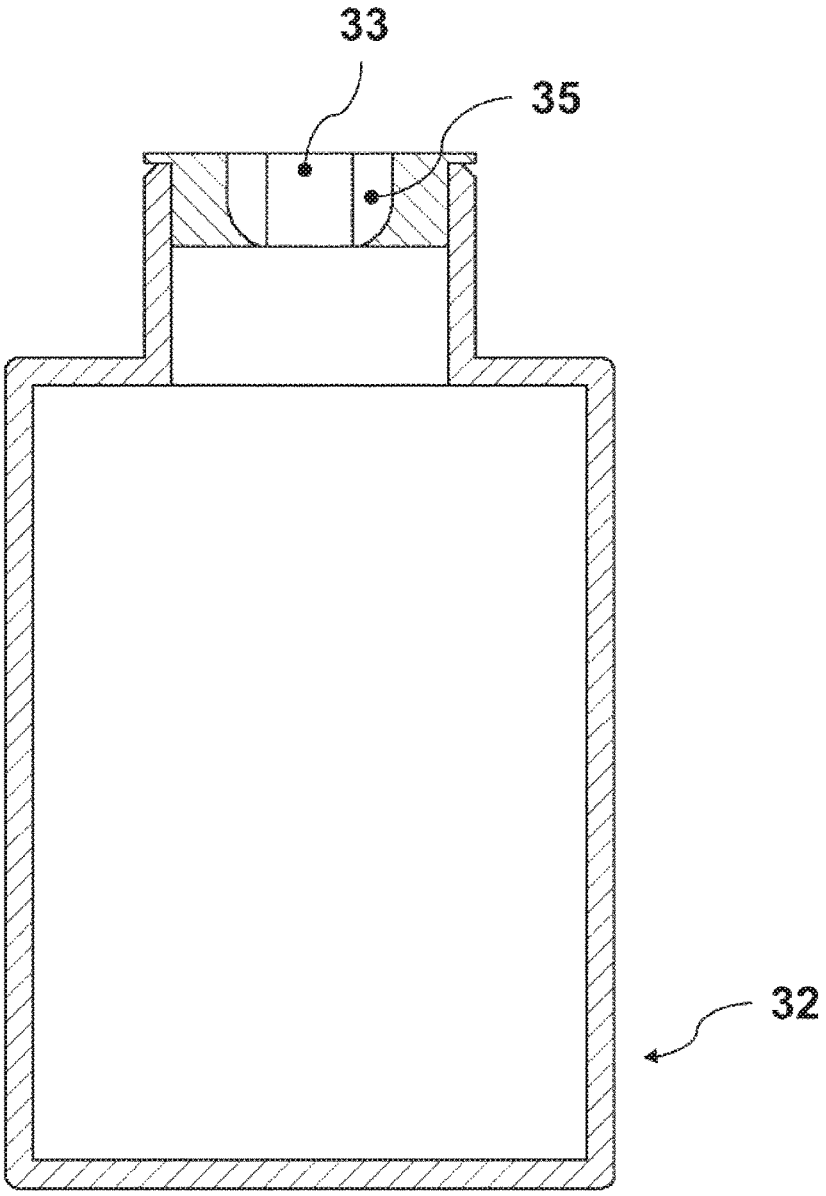
FIG. 3 shows a side cross sectional view through the media container, which is configured as a bottle in this embodiment.

Another embodiment of the media container 32 is shown in FIG. 3. In this case, the scraping implement 35 is integrated into the upper part of the neck of the bottle.

Figure 4:
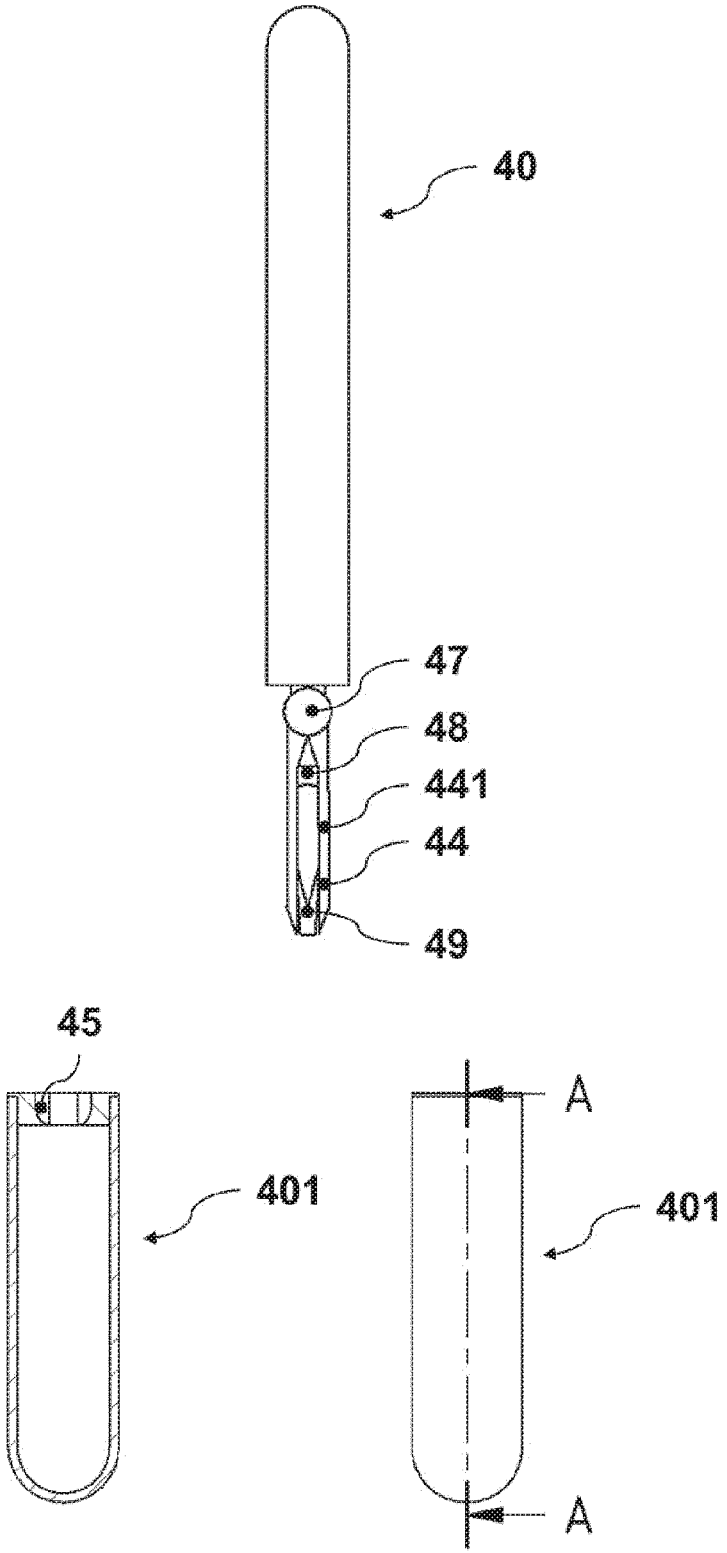
FIG. 4 shows an embodiment of the device according to the invention, configured as a pen, together with a pen cap configured as a container, in a side view (on the right) or in a cross sectional view (on the left) along the cross section line A-A.

FIG. 4 shows a special embodiment of the device 40 in the form of a pen with a closure cap 401 that, in one embodiment, can concurrently also serve as the media container of the pen-shaped device. In the media container embodiment, the closure cap has a scraping implement 45 on the opening side. Here, the support elements 441 can pivot relative to each other around a pivoting axle 47 and are joined via a flexible strip 48 in the form of a spring element. The two application elements 49 are each affixed to the insides of the delimiting elements 44.

Figure 5:
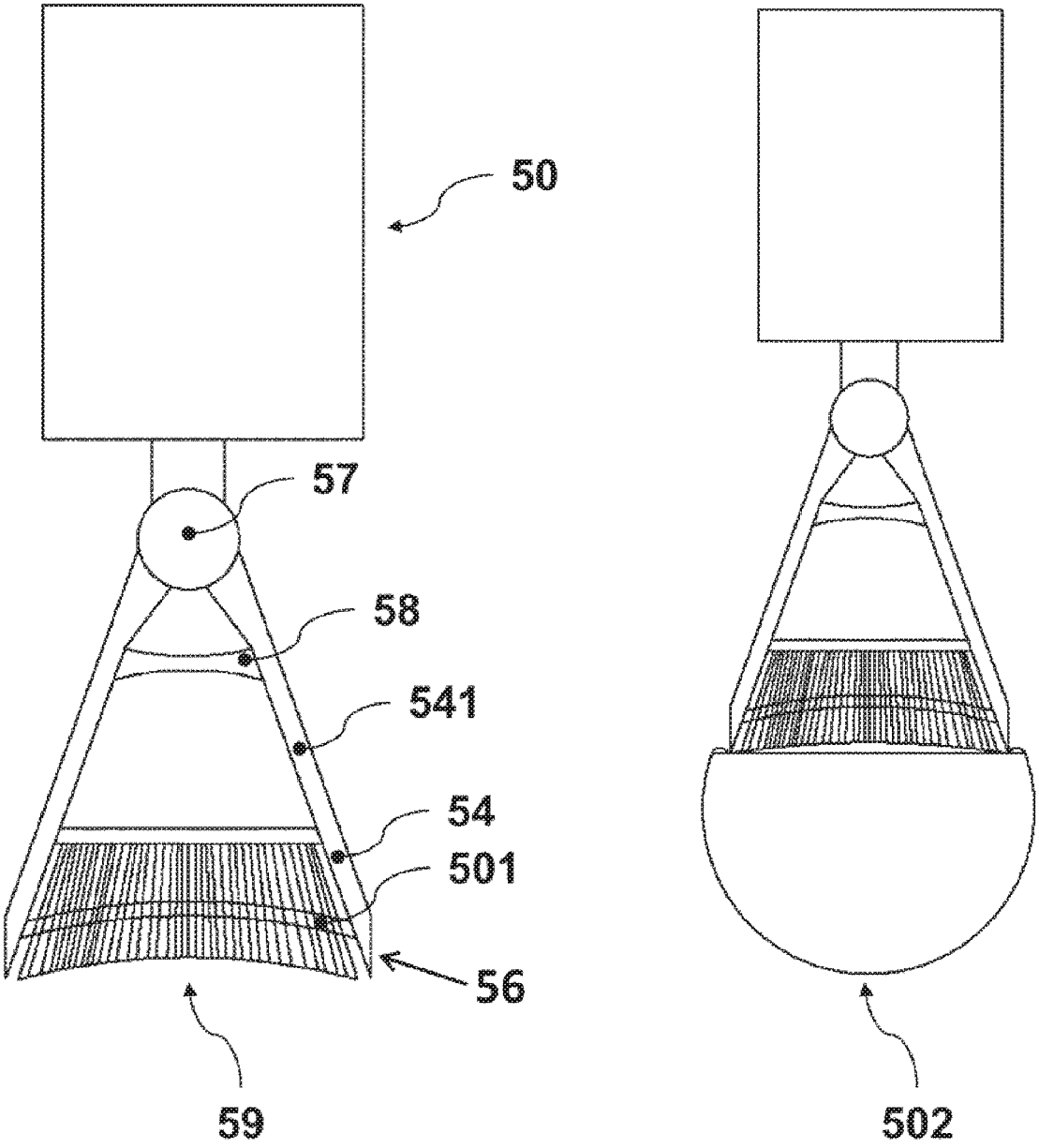
FIG. 5 shows a preferred embodiment of the device according to the invention with an application element consisting of a bristle bundle in a side view and, on the right, in a side view with a surface that is to be processed.

As an augmentation to FIG. 4, FIG. 5 provides a spreading aid 510 that, in this embodiment of the device 50, uniformly distributes the individual bristles of the application element 59 and spreads them out in a plane. Moreover, the device 50 is depicted during the media application onto the schematically indicated surface 502 of a fingernail.

Figure 6:
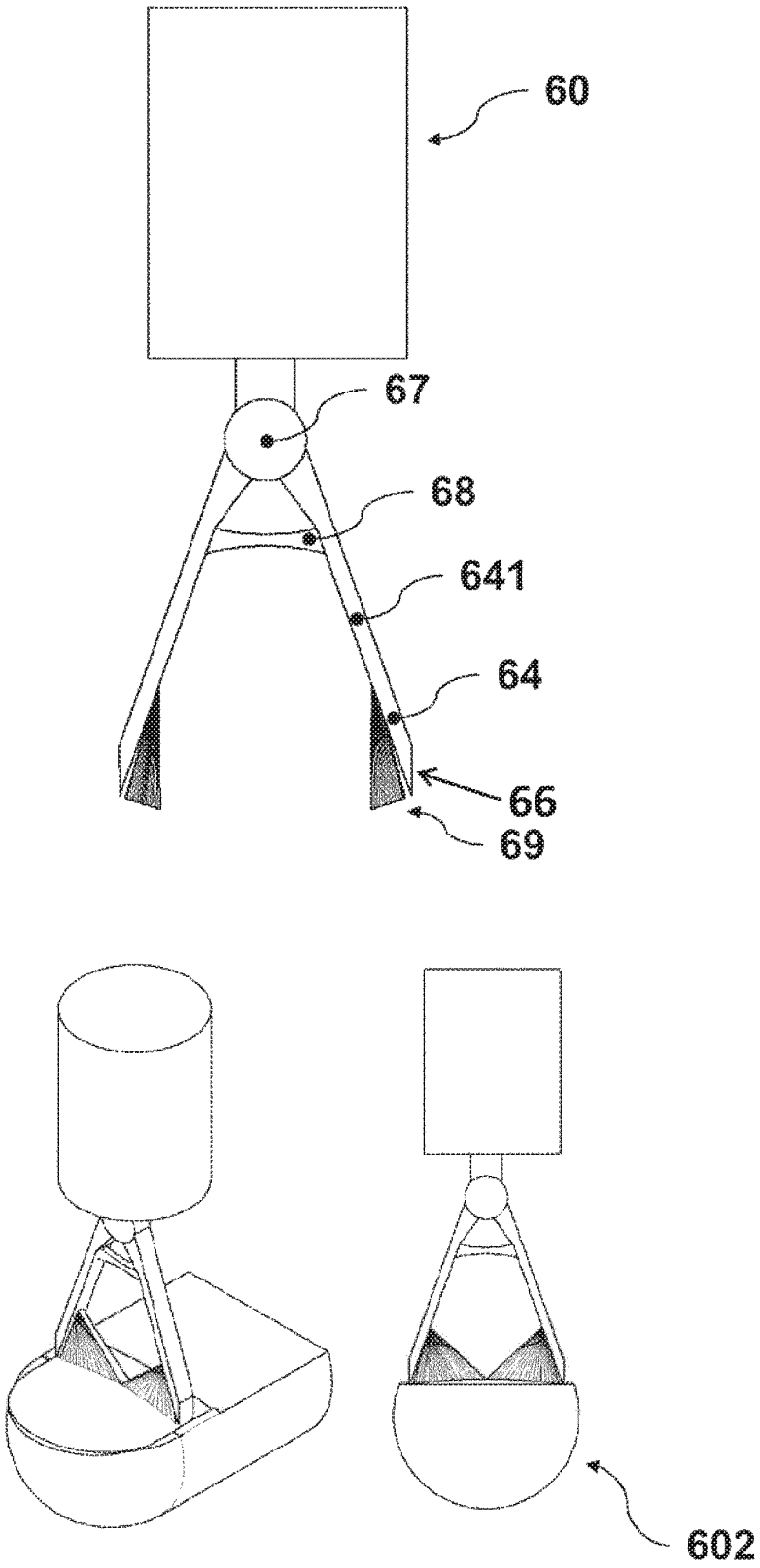
FIG. 6 shows a side view of another preferred embodiment of the device according to the invention with a support element consisting of two bristle bundles affixed to the lateral delimiting elements, namely, together with a surface that is to be processed, in a side view at the lower right, and in a perspective view at the lower left.

In contrast to FIG. 5, the device 60 in FIG. 6 does not have one but rather two application elements 69, which are affixed laterally on the two delimiting elements 64 and which fan open during the media application onto a schematically indicated fingernail surface 602, thereby forming an application surface.

Figure 7:
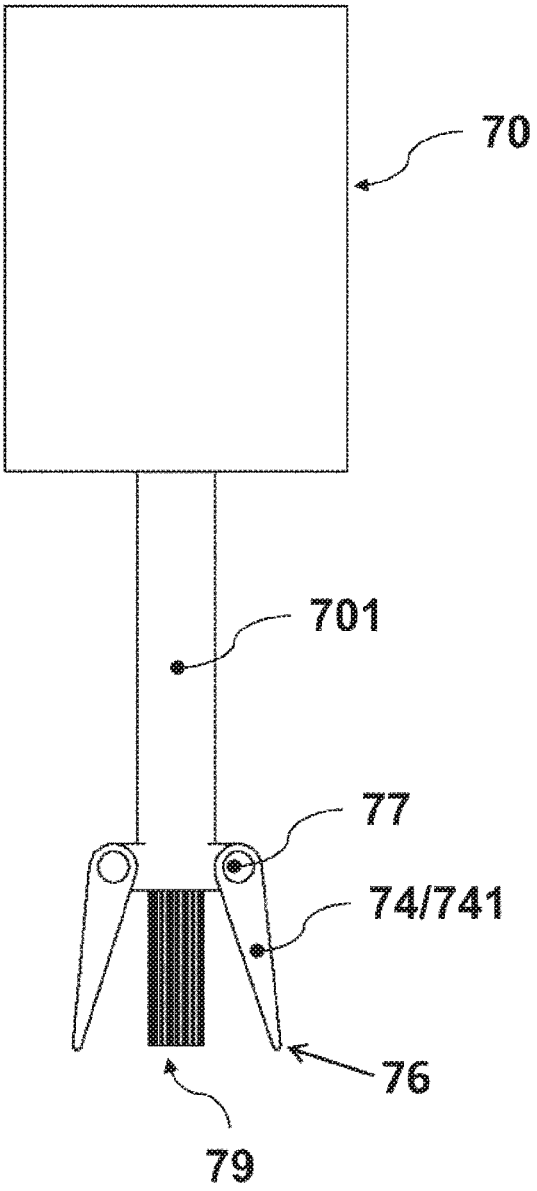
FIG. 7 shows another embodiment of the device according to the invention in a side view with two delimiting elements that each have an articulation.

FIG. 7 shows another embodiment of the device 70 in which the application element 79 is affixed as a bristle bundle that extends from the stem 701, and during its media application, it is delimited by two delimiting elements 74 that each have a pivoting axle 77.

Figure 8:
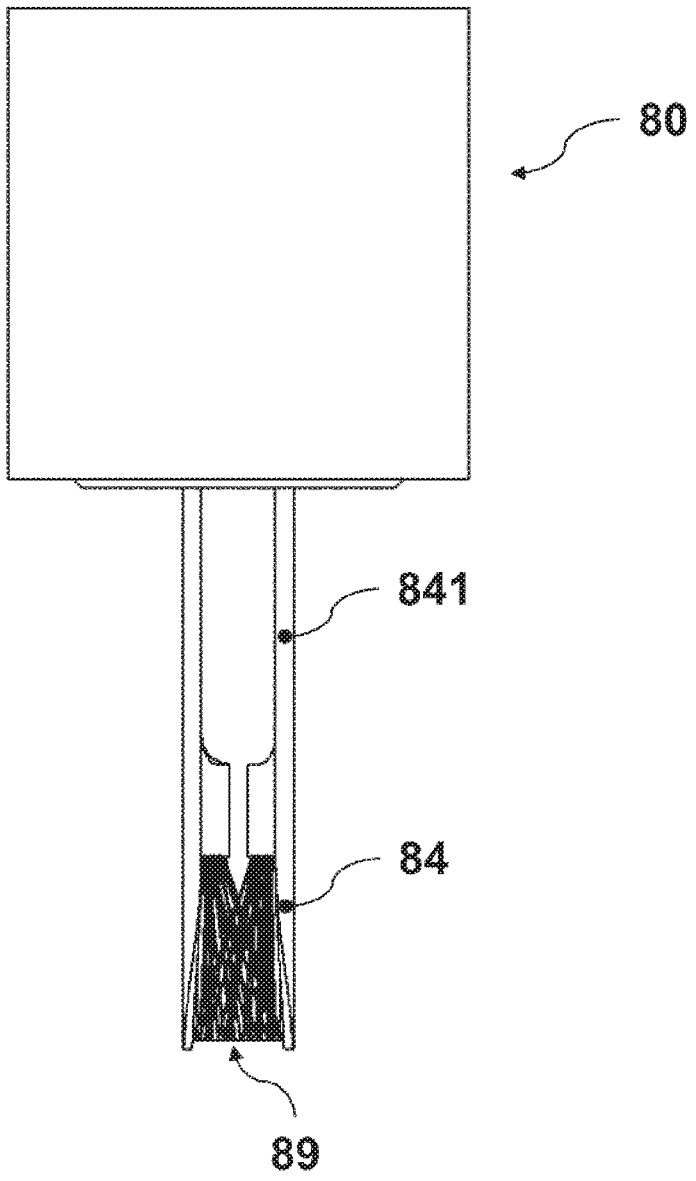
FIG. 8 shows another embodiment of the device according to the invention in a side view in which the rod-shaped support elements are made of a flexible material that permits pivoting.

Another embodiment of the device 80 is shown in FIG. 8, in which the two bristle bundles, as application elements 89, are held in sleeves which, in turn, are affixed to the inside of the support elements 841. These support elements, which run in parallel, are made of a flexible material and, in their end position, they open up into the delimiting elements 84.

Figure 9:
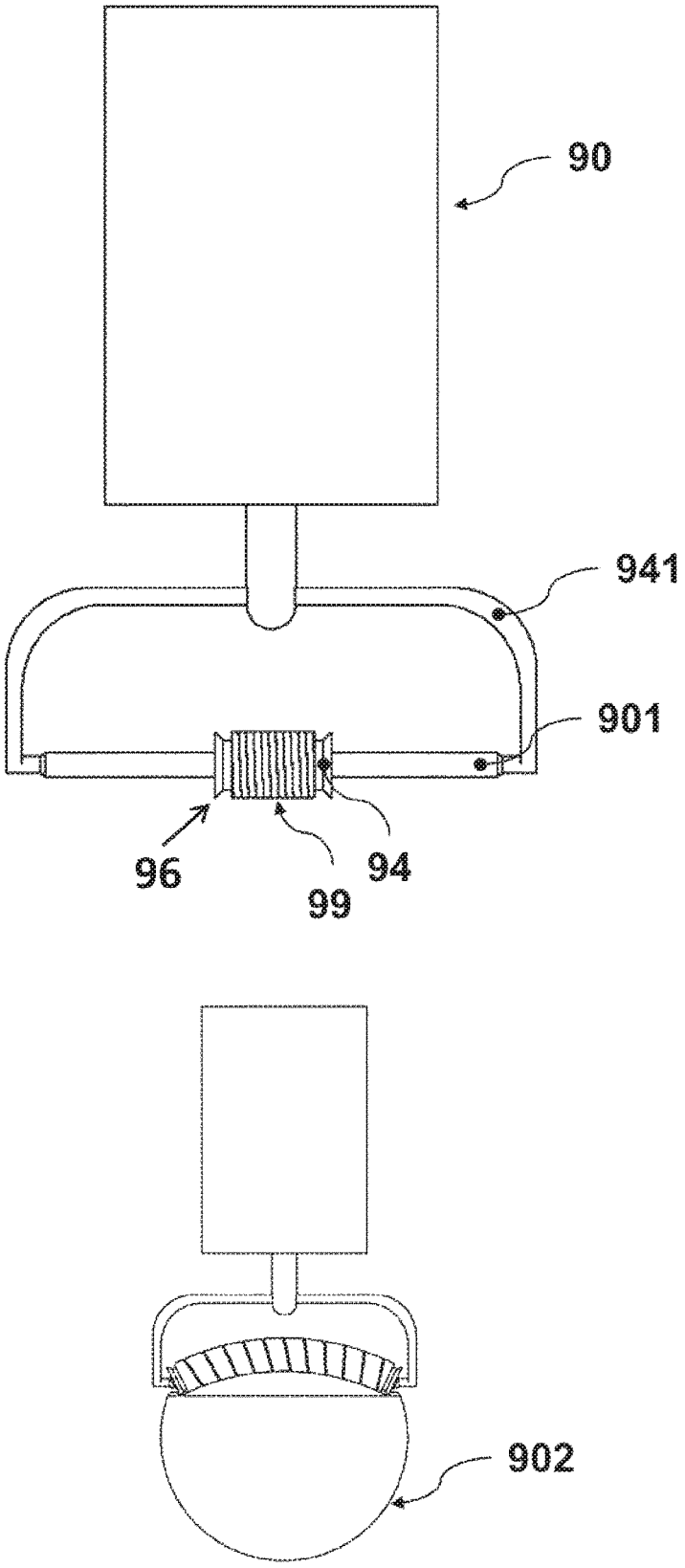
FIG. 9 shows another embodiment of the device according to the invention in a side view with a roller as the application element, and additionally, a side view of this embodiment in conjunction with a surface that is to be processed.

FIG. 9 shows the embodiment of the device 90 with a roller-shaped application element 99 in the initial position as well as on a schematically indicated surface 902 of a fingernail during the media application. Here, the roller 99 is configured with spiral-shaped indentations that allow the width to be varied. Furthermore, this roller is mounted on a flexible rotating axle 901 that stretches between two support elements 941. The delimiting elements are configured at both ends of the roller as circular end plates 94 that, as guide elements, have an outer edge 96, as a result of which they can follow along a surface structure or contour such as a groove, fold or edge.

Figure 10:
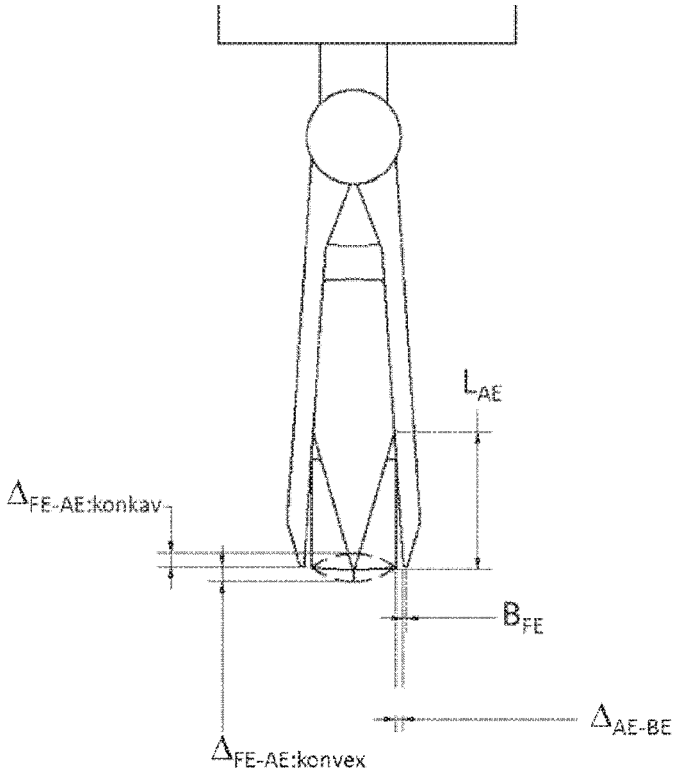
FIG. 10 shows relevant distances and dimensions of a device according to FIG. 6.

Based on the device shown in FIG. 6, FIG. 10 shows dimensions or distances that are relevant to the invention. The depicted device has two bristle bundles as the application element having a length $L_{AE}$. The bristle bundles are affixed in such a manner that a distance $\Delta_{AE\text{-}BE}$ is formed between the edge of the bristle bundles and the inner edge of the guide element. The guide element opens up into a tip having the width $B_{EE}$. In the case of a pair of bristle bundles that end concavely or convexly, the guide elements are arranged on the front at a distance $\Delta_{FE\text{-}AE:convex}$ or $\Delta_{FE\text{-}AE:concave}$ thereto. In (B), a device shown in a perspective view has a delimiting element whose width $B_{BE}$ is wider than the depth of the bristle bundles affixed to the inside thereof as application elements having a depth $T_{AE}$.

Definitions

In the context of the present invention, a delimitation of the media application towards the "outside" means that the media is prevented from being spread from the side of the delimiting element facing the application element to the side of the delimiting element facing away from the application element.

The person skilled in the art can glean additional variants of the invention and their execution from the preceding disclosure, from the figures and from the patent claims.

In the patent claims, terms such as "encompass", "comprise", "contain", "have" and the like do not exclude additional elements or steps. The use of the indefinite article does not preclude the plural. Each individual device can execute the functions of several of the units or devices cited in the patent claims. The reference numerals indicated in the patent claims are not to be construed as a limitation of the means and steps employed.

LIST OF REFERENCE NUMERALS device: 10, 40, 50, 60, 70, 80, 90
container cover: 11
media container: 12, 22, 32
opening for storing the device: 13, 23
container opening: 33
delimiting element(s): 14, 44, 54, 64, 74, 84, 94
guide element: 56, 66, 76, 96
scraping implement: 25, 35
lateral guide: 26
pivoting axle: 47, 57, 67, 77
spring element: 48, 58, 68
application element: 49, 59, 69, 79, 89, 99
gap to receive the guide element: 201
pen cap: 401
spreading aid: 501
surface: 502, 602, 902
stem: 701
elastic guide: 901
support element: 141, 441, 541, 641, 741, 841, 941

REFERENCES OF DIMENSIONS $L_{AE}$ length of the application element
$B_{FE}$ width of the guide element at its tip
$T_{AE}$ depth of the application element
$B_{BE}$ width of the delimiting element
$\Delta_{AE\text{-}BE}$ distance between the application element and the delimiting element
$\Delta_{FE\text{-}AE:concave}$ distance on the front between the guide element and the application element with a concave configuration
$\Delta_{FE\text{-}AE:convex}$ distance on the front between the guide element and the application element with a convex configuration

The invention claimed is:

1. A device for applying a liquid or pulverulent medium onto a surface, comprising:

an application element that serves to apply a liquid or pulverulent medium, that is situated between two support elements, and whose width can be changed flexibly, the application element comprising at least one bristle bundle, at least one sponge, or at least one flocked means, the at least one bristle bundle being connected to the device at one end and that has a spreading aid to uniformly distribute the individual bristles of the bristle bundle and to spread them out in a plane; and two delimiting elements that are positioned laterally on the application element and that are configured in such a way that they adapt to the flexible width of the application element and they laterally delimit the media application, wherein the two delimiting elements each comprise a guide element that detects the contour of the surface and that is configured in such a way that it flexibly adapts the width of the media application to the contour of the surface during the media application, and wherein either the delimiting elements are designed to be tapered so that the pointed end enters into contours or structures of the surface and thus guides the material application appropriately, or the guide element is configured as a ball or a roller.

2. A device for applying a liquid or pulverulent cosmetic or medical product onto a surface of the body of a human or animal, comprising:

an application element that serves to apply a liquid or pulverulent medium, that is situated between two support elements, and whose width can be changed flexibly, the application element comprising at least one bristle bundle, at least one sponge, or at least one flocked means, the at least one bristle bundle being connected to the device at one end and that has a spreading aid to uniformly distribute the individual bristles of the bristle bundle and to spread them out in a plane; and two delimiting elements that are positioned laterally on the application element and that are configured in such a way that they adapt to the flexible width of the application element and they laterally delimit the media application, wherein the two delimiting elements each comprise a guide element that detects the contour of the surface and that is configured in such a way that it flexibly adapts the width of the media application to the contour of the surface during the media application, and wherein the application element comprises at least one roller that can move flexibly crosswise to the axle of the roller and that runs on a flexibly movable roller axle that is affixed between the support elements, and in that the delimiting elements each consist of a plate-shaped element with a rectangular, trapezoidal, triangular, oval or circular outline.

3. The device according to claim 1, wherein the application element includes two rod-shaped support elements and two bristle bundles that are each attached laterally to the inside of the two rod-shaped support elements, wherein the two rod-shaped support elements are coupled so as to pivot around a pivoting axle and they are connected by at least one spring element in such a way that their pivoting motion can be pre-tensioned, and wherein during this pivoting motion, a tension is built up that counteracts the pivoting motion.

4. The device according to claim 2, wherein at least one delimiting element is attached directly to the side of the application element.

5. The device according to claim 1, wherein the liquid or the pulverulent or the medical product is selected from the group comprising nail polish, nail polish remover, nail care products, nail adhesives, adhesive gels, nail oil, lip care products, coatings for the dental sector, body powder, face powder, powder coatings, electrically hardening powder coatings, powder coatings that are hardened by means of UV light and powder coatings that are hardened by means of chemical processes.

6. The device according to claim 1 or 2, wherein the device is suitable for applying the liquid medium onto the surface of toenails or fingernails, teeth, skin or hair.

7. The device according to claim 1 or 2, wherein at least one of the surfaces of the guide elements and/or of the delimiting elements has a non-stick coating, a hydrophobic or oleophobic or superhydrophobic coating, a lotus coating or a microstructure or a nanostructure with non-stick properties.

8. A kit comprising:

a device according to claim 1 or 2; and a container (media container) that holds the medium that is to be applied, into which the device can be dipped.

9. The kit according to claim 8, wherein the media container comprises a scraping implement for scraping the liquid medium off the guide elements and/or off the delimiting elements.

10. A method for applying a liquid or pulverulent medium onto a surface, comprising:

providing the application element of a device according to claim 1 or 2, dipping into a media container that holds the liquid or pulverulent medium, a process in which the liquid or pulverulent medium is picked up;

scraping off the excess liquid or pulverulent medium from the application element and/or off the delimiting element and/or off the guide element by means of a scraping implement, wherein the scraping implement is configured as a gap that is at a distance from the media container; and applying the liquid or pulverulent medium onto the surface by bringing the application element into contact with the surface.

11. The device according to claim 2, wherein the delimiting elements each are a circular plate mounted so as to be rotatable around the axis of rotation.

12. The device according to claim 2, wherein the liquid or the pulverulent medium or the pulverulent cosmetic or the medical product is selected from the group comprising nail polish, nail polish remover, nail care products, nail adhesives, adhesive gels, nail oil, lip care products, coatings for the dental sector, body powder, face powder, powder coatings, electrically hardening powder coatings, powder coatings that are hardened by means of UV light and powder coatings that are hardened by means of chemical processes.

* * * * *